US010799405B2

(12) United States Patent
Bolkhovitinov et al.

(10) Patent No.: US 10,799,405 B2
(45) Date of Patent: Oct. 13, 2020

(54) WHEELCHAIR LIFT DEVICE

(71) Applicants: Andrew Bolkhovitinov, Reston, VA (US); Robin Ott, Salem, VA (US)

(72) Inventors: Andrew Bolkhovitinov, Reston, VA (US); Robin Ott, Salem, VA (US)

(73) Assignee: Bolkho, LLC, Reston, VA (US)

( * ) Notice: Subject to any disclaimer, the term of this patent is extended or adjusted under 35 U.S.C. 154(b) by 0 days.

(21) Appl. No.: 16/362,437

(22) Filed: Mar. 22, 2019

(65) Prior Publication Data

US 2019/0290511 A1 Sep. 26, 2019

Related U.S. Application Data

(60) Provisional application No. 62/646,873, filed on Mar. 22, 2018.

(51) Int. Cl.
*B66F 1/00* (2006.01)
*A61G 3/06* (2006.01)

(52) U.S. Cl.
CPC ..... *A61G 3/062* (2013.01)

(58) Field of Classification Search
CPC ..... B66F 1/00; B66F 3/00; B66F 3/10; B66F 5/00
See application file for complete search history.

(56) References Cited

U.S. PATENT DOCUMENTS

| | | | | |
|---|---|---|---|---|
| 4,811,924 | A * | 3/1989 | Walters | B66F 13/00 248/352 |
| 6,302,378 | B1 * | 10/2001 | Koch | B66F 15/00 254/131 |
| 6,341,763 | B1 * | 1/2002 | Lefebvre | B66F 15/00 254/131 |
| 7,434,782 | B2 * | 10/2008 | Arzouman | B66F 5/04 254/134 |
| 8,684,113 | B1 | 1/2014 | Laconis | |
| 2005/0238471 | A1 | 10/2005 | Ablabutyan | |
| 2007/0280808 | A1 | 12/2007 | Kio | |
| 2009/0058035 | A1 | 3/2009 | Babcock | |
| 2010/0207085 | A1 * | 8/2010 | Thurm | B66F 7/0641 254/2 C |
| 2010/0300777 | A1 | 12/2010 | Tallino | |
| 2013/0009372 | A1 | 1/2013 | Willis | |
| 2017/0304132 | A1 | 10/2017 | Bryant | |

OTHER PUBLICATIONS

PCT Written Opinion and Search Report (10 pages).

* cited by examiner

*Primary Examiner* — Lee D Wilson
(74) *Attorney, Agent, or Firm* — Woods Rogers PLC; Nathan A. Evans

(57) ABSTRACT

The present invention is directed to a wheelchair lift device, more particularly, to a folding wheelchair lift device that is independently operable by a wheelchair user without the wheelchair user exiting their chair. The wheelchair lift apparatus, in various embodiments, may include a linkage frame having a nesting linkage geometry; linkage frame components with alignment and locking features; an extension handle having alignment and locking features; and an adjustable telescopic axle-rest assembly having alignment and locking features.

10 Claims, 17 Drawing Sheets

WHEELCHAIR LIFT DEVICE

CROSS-REFERENCE TO RELATED APPLICATIONS

This application relies on the disclosure of and claims priority to and the benefit of the filing date of U.S. Provisional Application No. 62/646,873 filed Mar. 22, 2018, the disclosure of which is hereby incorporated by reference in its entirety.

BACKGROUND

Field of the Invention

The present invention is directed to a wheelchair lift device, more particularly, to a folding wheelchair lift device that is independently operable by a wheelchair user without the wheelchair user exiting their chair. The wheelchair lift apparatus, in various embodiments, may include a linkage frame having a nesting linkage geometry; linkage frame components with alignment and locking features; an extension handle having alignment and locking features; and an adjustable telescopic axle-rest assembly having alignment and locking features.

Description of the Related Art

Current state of the art wheelchair lift devices have three major shortcomings: 1) they do not work with lightweight active wheelchairs, 2) they cannot be independently operated by a wheelchair user without the user exiting their chair, and 3) they are not compact enough for daily carry. Current state of the art wheelchair lifts that consist of parallel-bar linkage architecture are designed to lift power wheelchairs only, and are not able to lift lightweight active wheelchairs. Also, the operation of these devices involves lifting the wheelchair through a downwards pull on a handle, which is not an ergonomic action for a wheelchair user to perform while in their chair. Fundamentally, these prior art devices were designed to be operated by wheelchair repair personnel—not wheelchair users. The need exists for a device that ergonomically can be operated by a wheelchair user themselves without the user getting out of their chair, especially for lightweight wheelchairs. The invention herein can be used to lift lightweight wheelchairs, can be operated by the wheelchair user without the user getting out of their chair, and can fold and lock into a compact size for daily carrying purposes.

SUMMARY

The present invention is directed to a folding wheelchair lift device, more particularly, to a folding wheelchair lift device that is operable by a wheelchair user without the wheelchair user exiting their chair. The wheelchair lift apparatus, in various embodiments, may include a frame having a nesting linkage geometry; a frame with alignment and locking features; an extension handle having alignment and locking features; and an telescopic axle-rest assembly having alignment and locking features.

In various embodiments, the device may include a parallel-bar-linkage architecture comprised of two inner horizontal links, two outer horizontal links, two short vertical links, two long vertical links, an extension handle, and a telescopic axle-rest assembly.

In one embodiment, the inner horizontal links may include a pair of holes as a bearing location for an axle to provide a structural rotation point between the inner horizontal links and the telescopic axle-rest assembly.

In one embodiment, the inner horizontal links may further include another pair of holes as a bearing location for a locking pin to be inserted through the inner horizontal links and the telescopic axle-rest assembly to provide structural rigidity between the components when the device is unfolded.

In one embodiment, the outer horizontal links may include press-fit pins to provide a structural alignment surface for the short and long vertical linkages when the device is folded or unfolded.

In one embodiment, the outer horizontal links may further include a rectangular cutout to provide a nesting action between an S-shaped bend in the long vertical links and the outer horizontal links when the device is folded.

In one embodiment, the long vertical links may include an S-shaped bend to provide geometrical clearance between the long vertical links and the rectangular cutout in the outer horizontal links when the device is folded.

In one embodiment, the extension handle may include a slotted member to provide structural rigidity of the handle assembly, geometrical alignment with the long vertical links when the device is unfolded, geometrical alignment with the outer horizontal links when the device is folded, and locking features with the inner horizontal links when the device is folded.

In one embodiment, the telescopic axle-rest assembly may include an outer tube, an inner tube, and an axle-cup, providing an adjustable-height surface to interface with the wheelchair axle.

In one embodiment, the outer tube may include a pair of holes as a bearing location for an axle to provide a structural rotation point between the inner horizontal links and the telescopic axle-rest assembly.

In one embodiment, the outer tube may further include another pair of holes as a bearing location for a locking pin to be inserted through the inner horizontal links and the telescopic axle-rest assembly to provide structural rigidity between the components when the device is unfolded.

In one embodiment, the outer tube may further include a locking mechanism between the outer tube and inner tube to provide structural height-adjustment for the axle-cup. The axle-cup may be rigidly attached to the top of the inner tube.

In one embodiment, the axle-cup may include a v-shaped groove on the top surface to provide wheelchair-alignment during the lift process. The round wheelchair axle contacts the v-shaped groove on the axle-cup at only two points, which causes the wheelchair lift device to self-center with the wheelchair axle.

In one embodiment, the axle-cup may include two bumps on the bottom surface to provide alignment with the outer horizontal links when the device is folded. When the two bumps on the axle-cup geometrically mate with the curved ends of the horizontal links, and when the outer tube and inner tube are locked in this position, the telescopic axle-rest assembly is rotationally constrained when the device is closed.

DETAILED DESCRIPTION OF THE INVENTION

Figure 1:
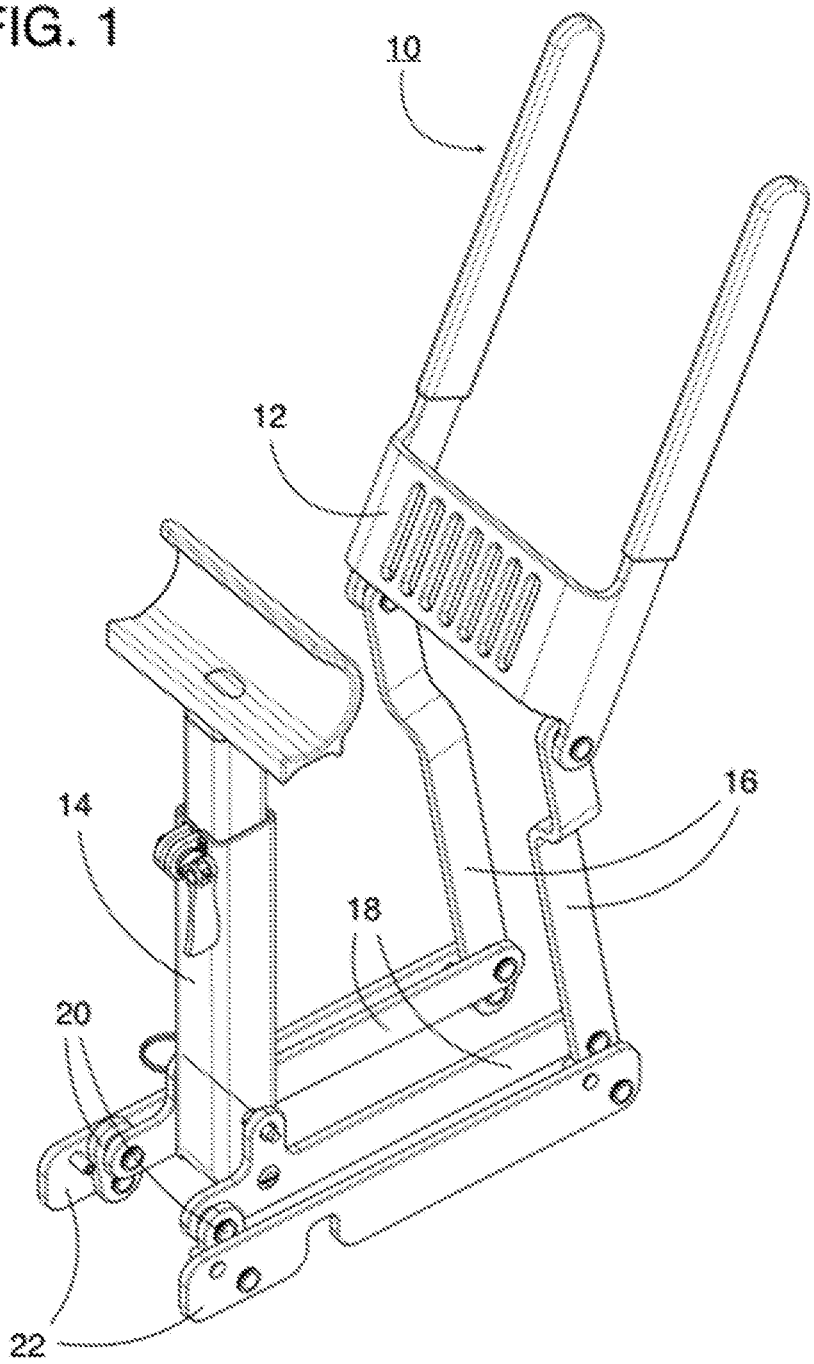
FIG. 1 is a diagram illustrating the parallel-bar-linkage architecture (10), comprised of two inner horizontal links (18), two outer horizontal links (22), two short vertical links (20), two long vertical links (16), an extension handle (12), and a telescopic axle-rest assembly (14) according to one embodiment of the present invention.

The present invention is described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. One skilled in the art will recognize that the systems and devices of embodiments of the invention can be used with any of the methods of the invention and that any methods of the invention can be performed using any of the systems and devices of the invention. Embodiments comprising various features may also consist of or consist essentially of those various features. Other embodiments of the invention will be apparent to those skilled in the art from consideration of the specification and practice of the invention. The description of the invention provided is merely exemplary in nature and, thus, variations that do not depart from the essence of the invention are intended to be within the scope of the invention.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

FIG. 1 is a diagram illustrating the parallel-bar-linkage architecture (10), comprised of two inner horizontal links (18), two outer horizontal links (22), two short vertical links (20), two long vertical links (16), an extension handle (12), and a telescopic axle-rest assembly (14) according to one embodiment of the present invention. A four-bar-linkage created by (16), (18), (20), and (22) is the primary lifting mechanism. Both of the inner and outer horizontal links, (18) and (22), stay parallel with each other, and both of the vertical links, (16) and (20), stay parallel with each other. (22) contacts the ground while the device is in use, while (18) is lifted by the motion of (16) and (20) as described below.

Low-friction rotating joints exists between (22) and (20), between (20) and (18), between (18) and (16) and between (16) and (22). The linkage works by a force being applied on the end of (16), which causes (16) and (20) to rotate. The rotation of (16) and (20) causes (18) to lift off the ground.

The mechanical advantage of the linkage is derived from the inventive and manufactured difference in link length between (16) and (20). For example, if (16) is 10 times longer than (20), then a force at the end of (16) will be multiplied by 10 at link (20). Or in other words, in order to lift a certain force at (20), only one tenth of that force applied to the end of (16) would be required to support that load at (20).

Extension handle (12) is attached to the two long vertical links (16) with a similar rotating joint that attaches (16), (18), (20), and (22), but, in aspects, should not be low friction. A constant-torque rotation joint may be used to connect (16) and (12).

The purpose of (12) is to allow the linkage assembly of (16), (18), (20), and (22) to be actuated by a user that is still sitting in the wheelchair. A force or rotation on (12) will translate into a force or rotation on (16), which will actuate the linkage mechanism as described previously.

Figure 6A:
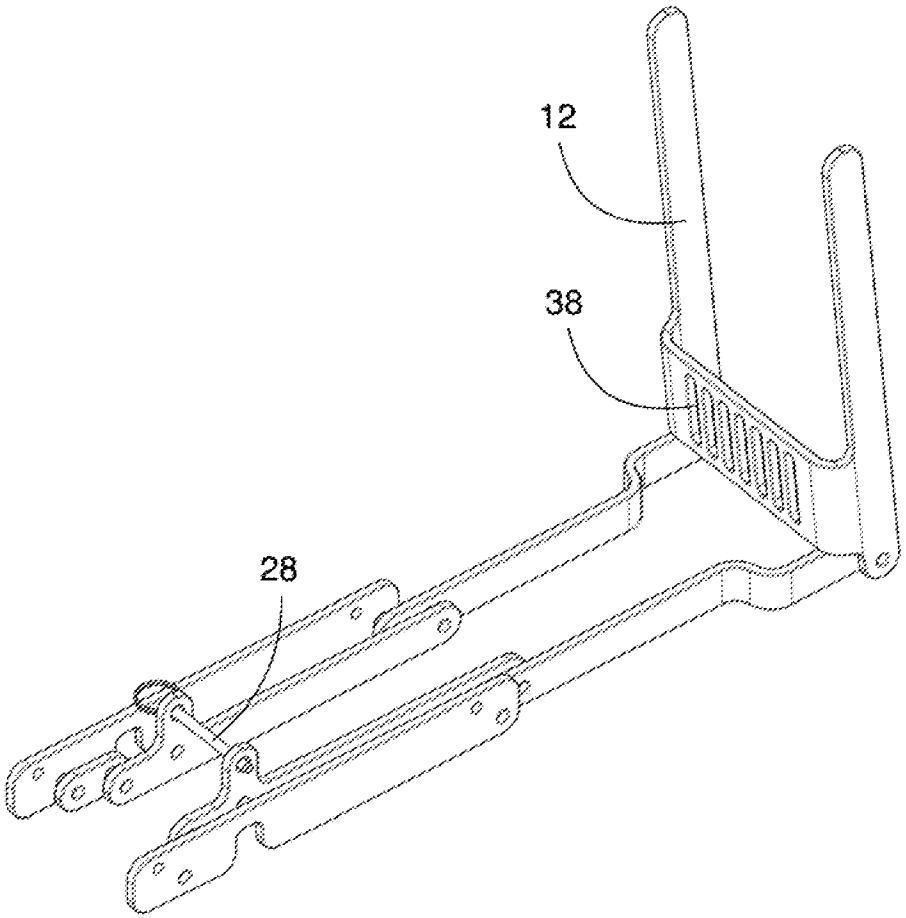
FIGS. 6A-6C are diagrams illustrating the slotted member on the extension handle when the device is folded (6A-6B) and unfolded (6C) according to one embodiment of the present invention.
Figure 6B:
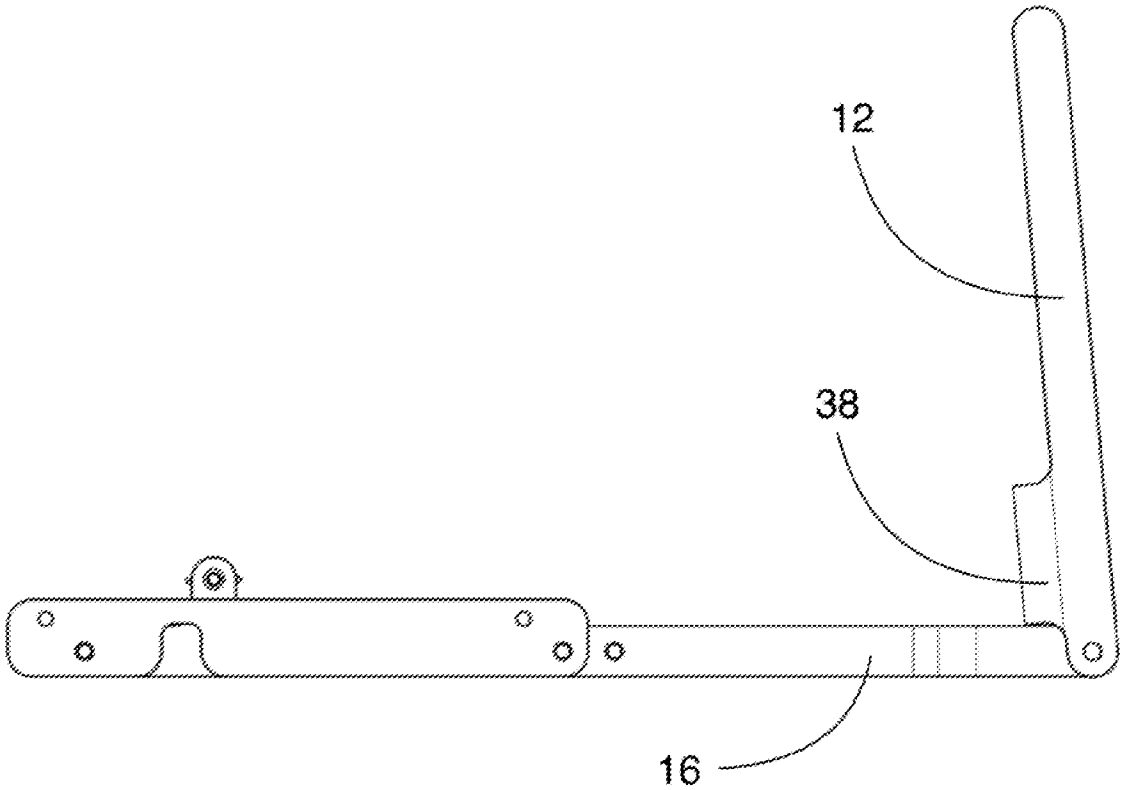
Figure 6C:
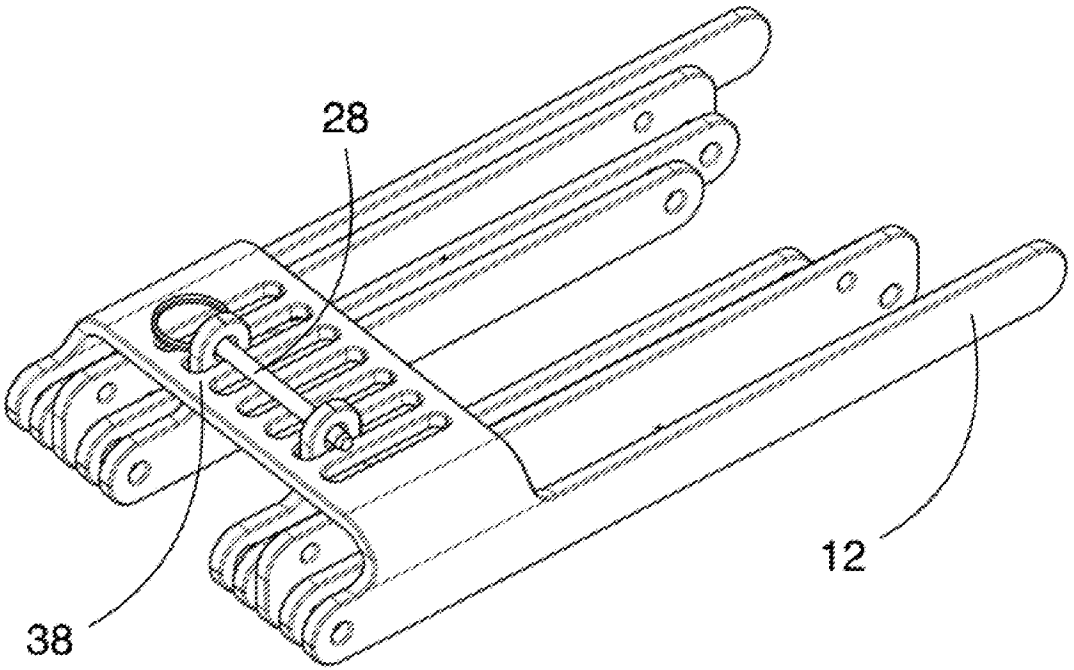

The extension handle (12) is described in depth in the detailed descriptions for FIG. 6A, FIG. 6B, and FIG. 6C. The telescopic axle-rest assembly (14) is described in depth in the detailed descriptions of FIG. 7, FIG. 8, FIG. 9, FIG. 10, FIG. 11A, FIG. 11B, FIG. 12A, and FIG. 12B.

Figure 2:
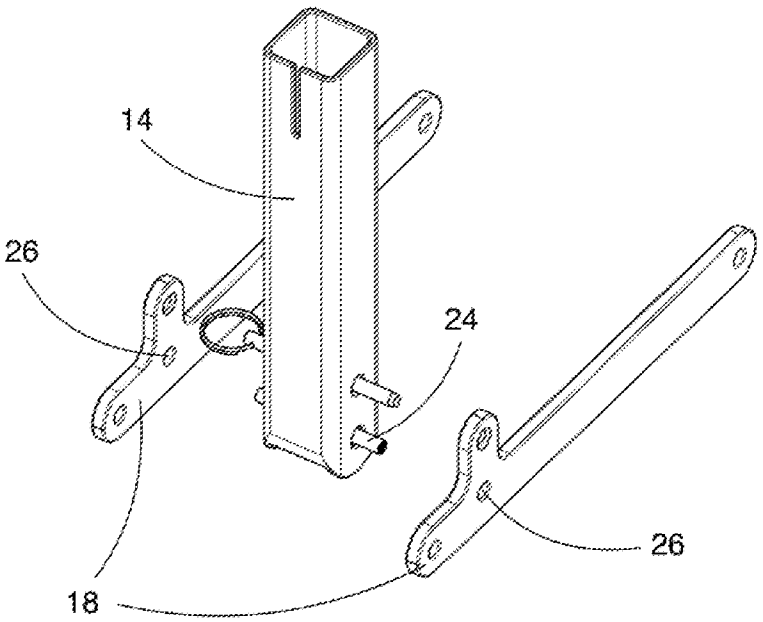
FIG. 2 is a diagram illustrating the axle holes in the inner horizontal links, and how they interface with the axle and telescopic axle-rest assembly according to one embodiment of the present invention.

FIG. 2 is a diagram illustrating the axle holes (26) in the inner horizontal links (18) and how they interface with the axle (24) and the telescopic axle-rest assembly (14) according to one embodiment. (14) and (18) are held together with a rotating joint composed of the axle (24). (24) passes through (14) and (26) to provide a rotation point. The purpose of this rotation point is to allow (14) to fold down between (18) when the device is folded. In aspects, when the device is folded, (14) is parallel with (18). When the device is unfolded, in aspects, (14) is perpendicular to (18).

Figure 3:
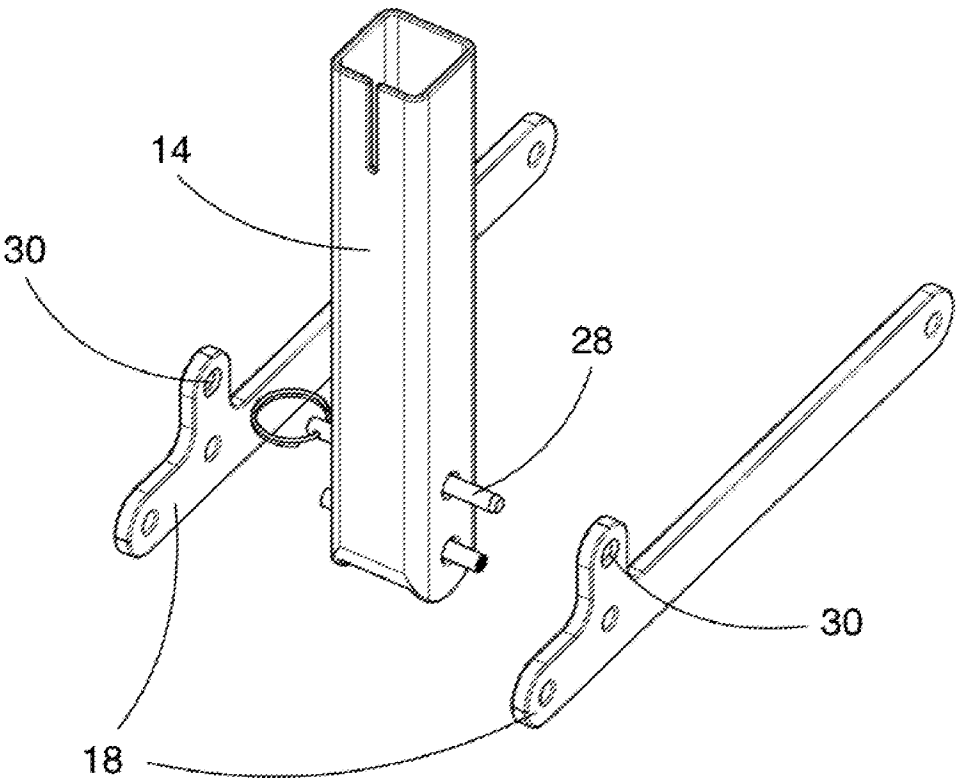
FIG. 3 is a diagram illustrating the pin holes in the horizontal links, and how they interface with the locking pin and the telescopic axle-rest assembly according to one embodiment of the present invention.

FIG. 3 is a diagram illustrating the pin holes (30) in the horizontal links (18), and how they interface with the locking pin (28) and the telescopic axle-rest assembly (14)

according to one embodiment of the present invention. The purpose of (28) is to lock (14) and (18) rigidly together when the device is unfolded by passing through the pin holes (30) in (18) and the holes in (14) as described in the detailed description for FIG. 8. (28) prevents rotation about the axle assembly (24), which causes (14) to be rigid with (18). The purpose of locking (14) with (18) is to allow (14) to stay upright during the lifting process. During a lift, the (14), (28), (18) assembly is lifted with the linkage mechanism shown in FIG. 1.

In one embodiment, the pin holes (30) and the holes in (14) may include chamfers on both edges of the hole to aid the insertion of (28). This lets the user more easily insert and remove the locking pin (28). The locking pin (28) may include a thumb ring at one end to provide a grip surface on the pin for the user. (28) may also include a chamfer on the end to aid the insertion into (30) and the holes in (14).

Figure 4A:
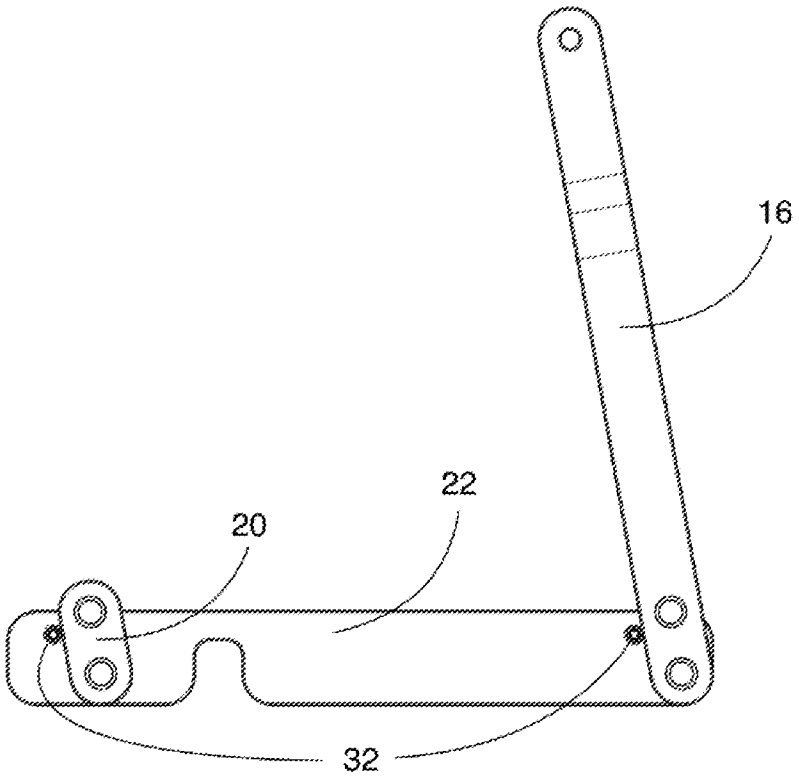
FIGS. 4A-4B are diagrams illustrating the press-fit pins in the outer horizontal links and how they interface with the short and long vertical links when the device is unfolded (4A) and folded (4B) according to one embodiment of the present invention.

FIG. 4A is a diagram illustrating the press fit pins (32) in the outer horizontal links (22) and how they interface with the short vertical links (20) and the long vertical links (16) when the device is unfolded. As shown in FIG. 1, (16) and (20) stay parallel with each other during the lifting motion of the linkage assembly. The purpose of (32) is to provide a hard-stop for (16) and (20) to prevent the links from rotating. In aspects, (32) is attached to (22) by means of press-fit interference. The geometrical location of (32) is such that the angle of (16) relative to (22) is, in embodiments, less than 90 degrees. The purpose of (16) being less than 90 degrees relative to (22) when the device is unfolded is that it prevents the lifted user from lowering back down unintentionally. When the user is lifted in the up position, the weight of the user puts a downwards load on (16) and (20), which causes (16) and (20) to want to rotate towards (32) with a counter-clockwise motion. This rotation towards (32) in the raised position prevents (16) or (20) from rotating clockwise.

Figure 4B:
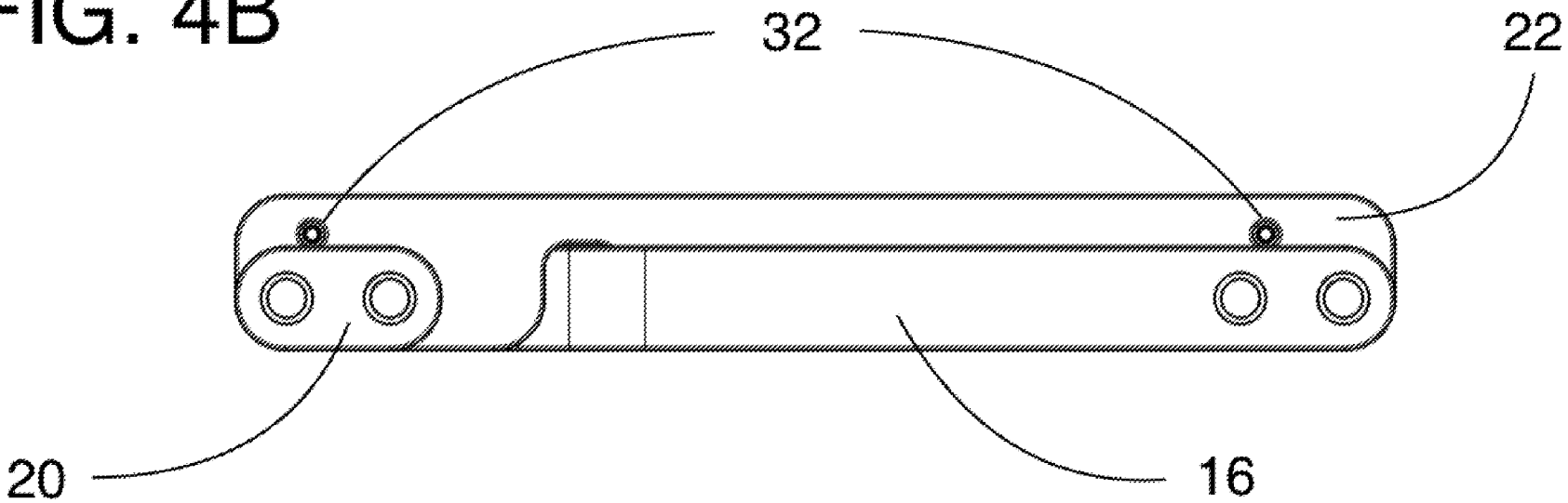

FIG. 4B is a diagram illustrating the press fit pins (32) in the outer horizontal links (22) and how they interface with the short vertical links (20) and the long vertical links (16) when the device is folded. As described in the description for FIG. 1, (16) and (20) stay parallel with each other during the lifting motion of the linkage assembly. The purpose of (32) is to provide a hard-stop for (16) and (20) to prevent the links from rotating. In aspects, (32) is attached to (22) by means of press-fit interference. The geometrical location of (32) is such that (16) and (20) will be parallel with (22) when the device is folded. Thus, (32) acts as a hardtop when the device is closed (FIG. 4A) as well as when the device is raised (FIG. 4B).

Figure 5A:
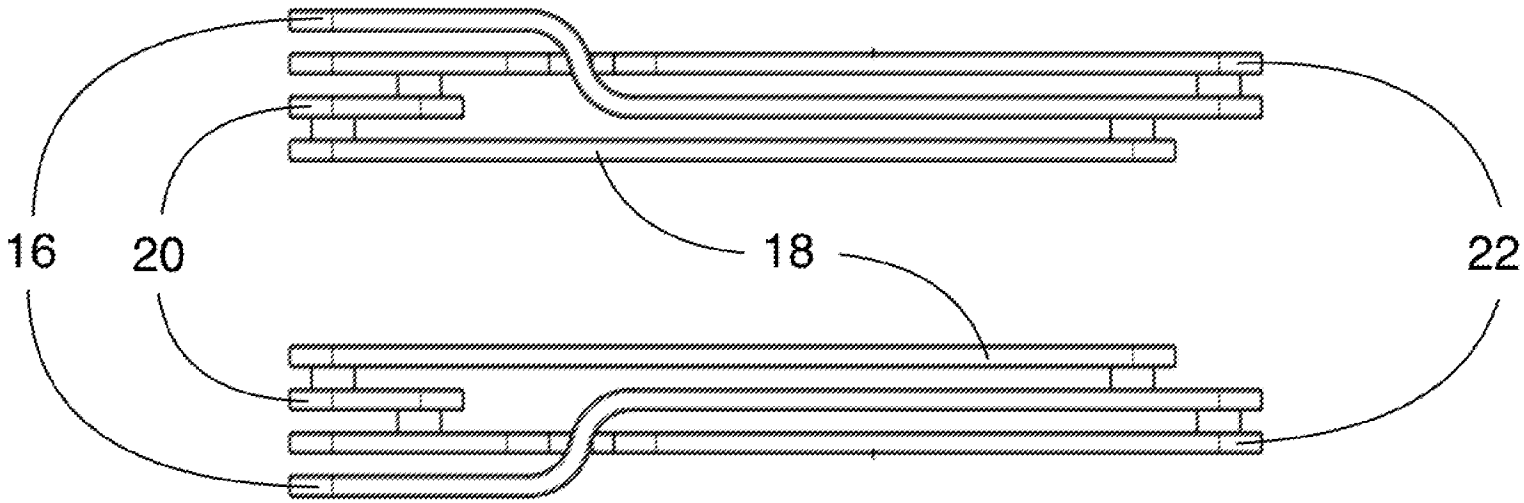
FIGS. 5A-5C are diagrams illustrating the nesting action between an S-shaped bend in the long vertical links and the rectangular cutout in the horizontal links according to one embodiment of the present invention.

FIG. 5A is a diagram illustrating the nesting action between the S-shaped bend (34) in the long vertical links (16) and the rectangular cutout (36) in the outer horizontal links (22) according to one embodiment of the present invention. FIG. 5A illustrates a bottom-view of the linkage assembly as described in FIG. 1 of (16), (18), (20) and (22). The purpose of the nesting action between (16) and (22) is to allow the linkage assembly to have a long handle that is, in aspects, one piece with the linkage frame, but still have the linkage assembly fold down to a small size. The purpose of the S-bend (34) in (16) is to prevent (16) from hitting (20). In a standard four-bar-linkage assembly, a straight long vertical linkage, without an S-bend, may hit (20).

Figure 5B:
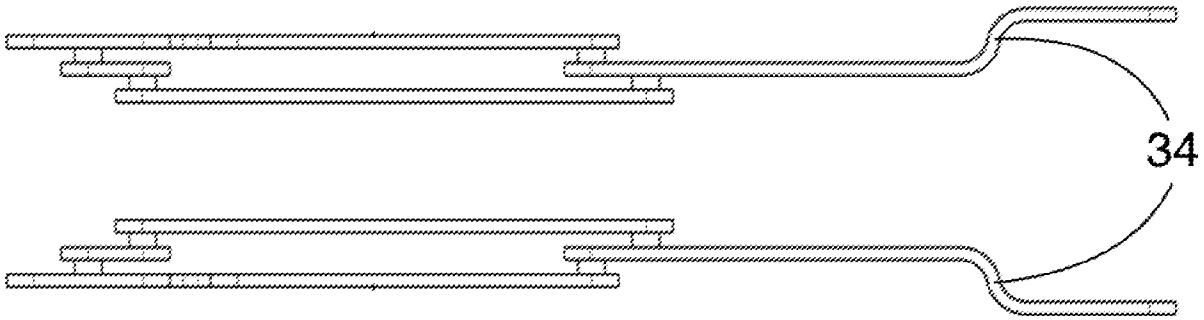

FIG. 5B is a diagram that calls out the S-shaped bend (34) in the long vertical links (16) according to one embodiment. In this diagram, the length of (16) relative to the whole linkage assembly is also apparent. The nested linkage system as described in this invention allows for a much longer vertical link length (16), while still keeping the linkage fully foldable. The size of the (34) is determined by the amount of width needed to fully clear (20) and (22). For thicker linkage material, (34) must be larger. Thus, for thinner linkage material, (34) must be smaller.

Figure 5C:
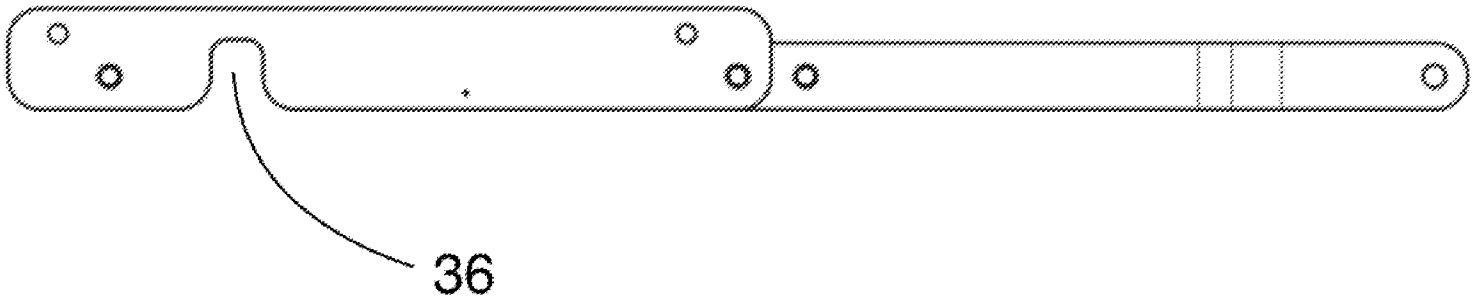

FIG. 5C is a diagram that calls out the rectangular cutout (36) in the outer horizontal links (22) according to one embodiment. The height of (36) is determined by the width of (16). The width of (36) is determined by the material thickness of (16). For a thicker material used for (16), the width of (36) must be increased to accommodate the larger S-bend. In order for a proper nesting action to occur, there must be enough clearance between (16) and (22). (36) is sized such that, when the device is folded, the S-bend (34) does not contact (36). The reason for this clearance between (34) and (36) is that there is already alignment hard-stops between (22) and (16) as described in the description of FIG. 4B.

FIG. 6A is a diagram illustrating the slotted member (38) on the extension handle (12) when the device is unfolded. In one embodiment, (38) is used to provide structural rigidity to the handle assembly of (12) and (16). Without (38), the (12) and (16) assembly is composed of thin links that would bend. (38) makes this assembly more rigid so that when (12) is pulled by the user, the (12) and (16) assembly does not flex or bend, or only flexes or bends to a degree that does not meaningfully affect performance of the invention taught herein.

FIG. 6B is a diagram illustrating the slotted member (38) on the extension handle (12) when the device is unfolded. In one embodiment, (38) is used as an angular hard-stop between the extension handle (12) and the long vertical links (16) when the device is unfolded. The purpose of having an angular hard-stop provided by (38) between (16) and (12) is that it allows (12) to be repeatably positioned when the user reaches down to grab (12) to actuate a lifting operation.

In one embodiment, the relative location of (38) up or down the length of (12) can be adjusted to change the relative angle between (12) and (16). If (38) is positioned closer towards the end of (12), the relative angle between (12) and (16) decreases. Additionally, if (38) is positioned father away from the ends of (12), the relative angle between (12) and (16) increases. In one embodiment, (38) is detachable from (12) by means of velcro or other adhesives such that the relative angle of (12) and (16) can be adjusted by the user.

FIG. 6C is a diagram illustrating the slotted member (38) on the extension handle (12) when the device is folded. In one embodiment, (38) is used as a locking feature to prevent (12) from rotating relative to the frame when the device is closed. The slots in (38) pass through the tabs on the inner horizontal links (18), and the locking pin (28) is inserted back into the pin holes (30) in the horizontal links (18). The interference of (28) and (38) prevents (12) from rotating open. The face of (38) that contacts the outer horizontal links (22) provides a hard-stop for (12), which keeps (12) parallel with (22) when the device is closed.

Figure 7:
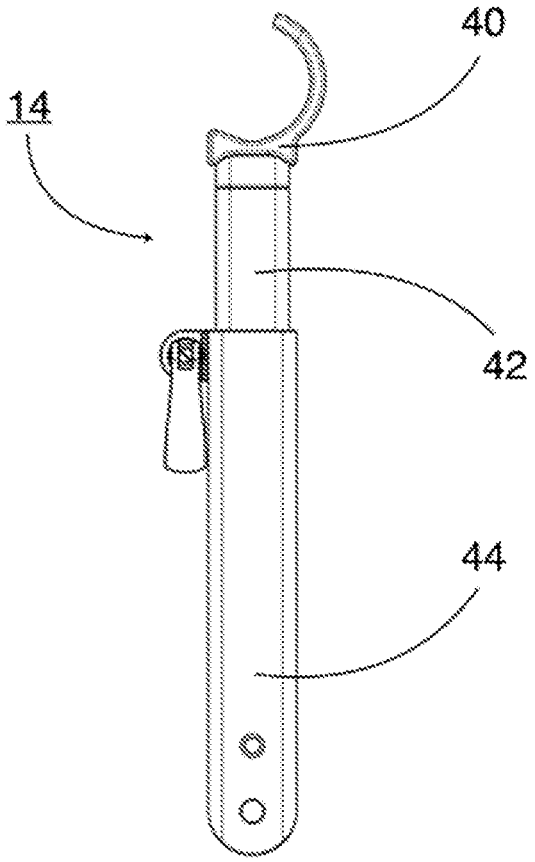
FIG. 7 is a diagram illustrating the telescopic axle-rest assembly according to one embodiment of the present invention.

FIG. 7 is a diagram illustrating the telescopic axle-rest assembly (14), which may include, in one embodiment, an outer tube (44), an inner tube (42) and an axle-cup (40). The purpose of the axle-rest assembly (14) is to provide a point of contact between the lifting device and the axle of the wheelchair, as described in the detailed description of FIGS. 11A-B.

Figure 8:
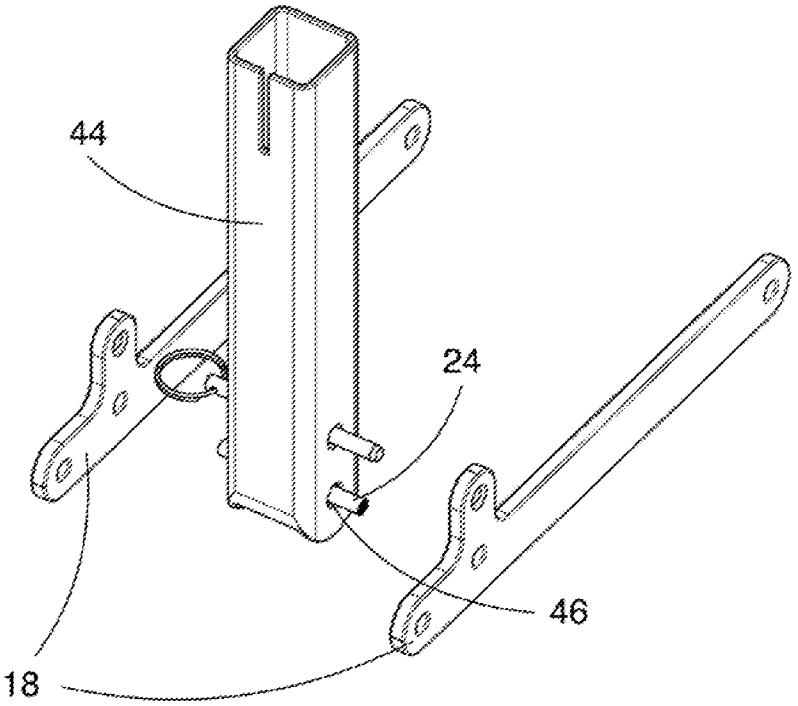
FIG. 8 is a diagram illustrating the axle holes in the outer tube, and how they interface with the inner horizontal links according to one embodiment of the present invention.

FIG. 8 is a diagram illustrating the axle holes (46) in the outer tube (44), and how they interface with the inner horizontal links (18) and the axle (24) according to one embodiment. The purpose of (46) is to provide holes for the (24) to pass through (44) to provide a structural rotation point between (14) and (18) as described in the detailed description of FIG. 2.

Figure 9:
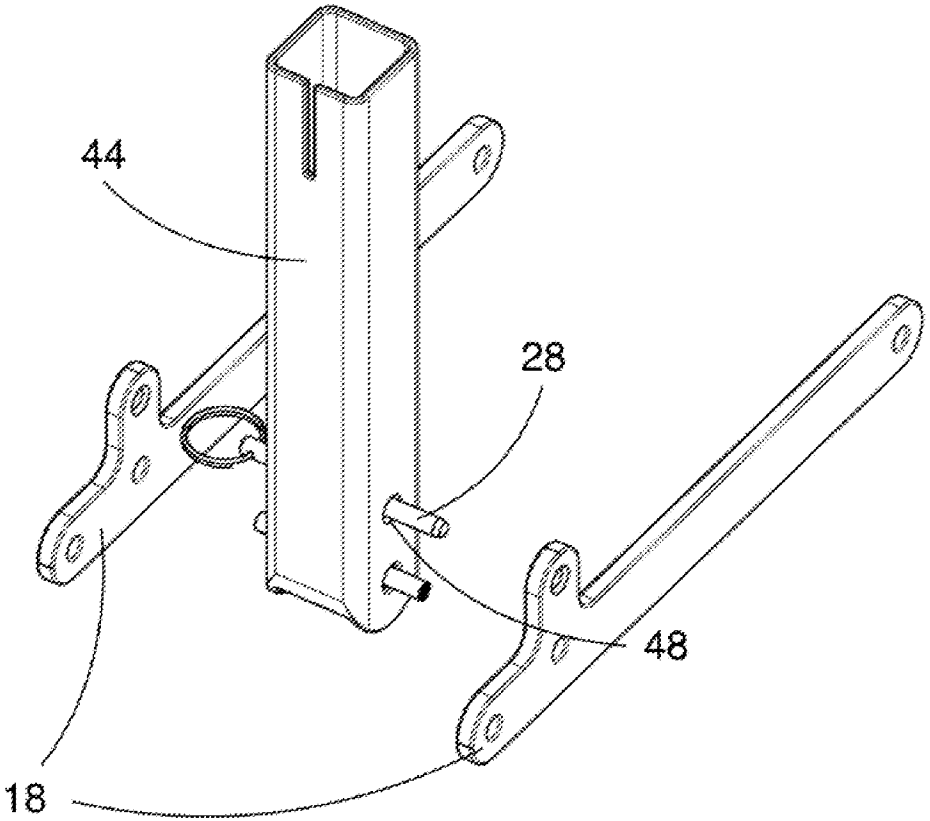
FIG. 9 is a diagram illustrating the pin holes in the outer tube, and how they interface with the pin and the inner horizontal links according to one embodiment of the present invention.

FIG. 9 is a diagram illustrating the pin holes (48) in the outer tube (44), and how they interface with the locking pin (28) and the inner horizontal links (18) according to one embodiment. The purpose of (48) is to provide an insertion point of (28) in order to rigidly connect (44) and (18) when the device is in the open position, as described in the detailed description of FIG. 3. In one embodiment, the edges of (48) may be chamfered to aid the insertion and removal of (28) into and out of the (18), (44) assembly.

Figure 10:
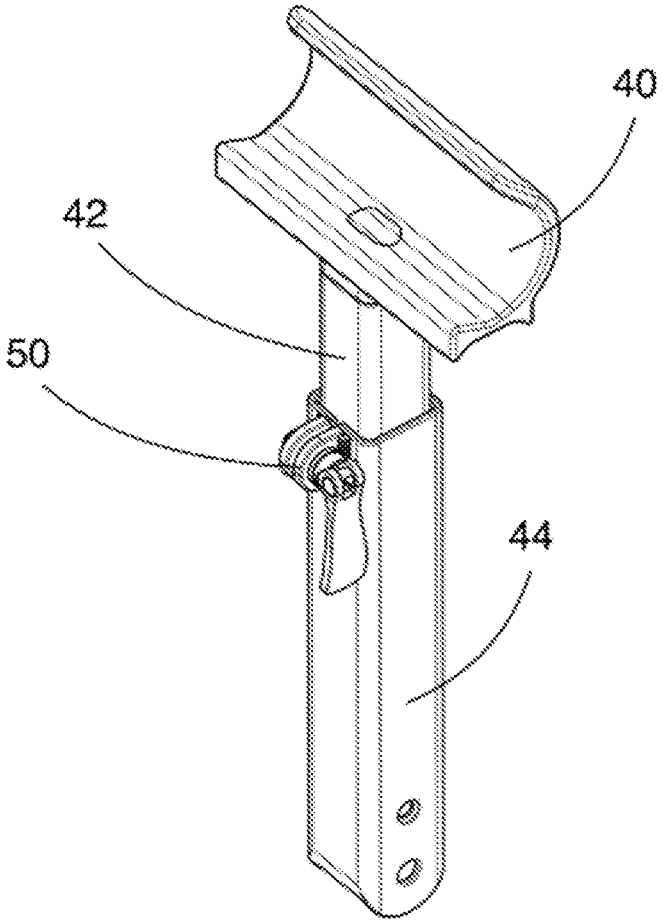
FIG. 10 is a diagram illustrating the locking mechanism between the inner tube and the outer tube according to one embodiment of the present invention.

FIG. 10 is a diagram illustrating the locking mechanism (50) between the inner tube (42) and the outer tube (44) within the telescopic axle-rest assembly (14) according to one embodiment. The purpose of (50) is to provide structural height adjustment of (42) relative to (44), with the goal of being able to adjust the height of the axle-cup (40). The purpose of an adjustable-height axle-cup (40) is to enable the lifting device to be compatible to lift wheelchairs of different wheel diameters. In one embodiment, the locking mechanism (50) includes a cam-lever and welded-tab design which would tighten the top edge of (44) around (42), causing (42) and (44) to lock together.

Figure 11B:
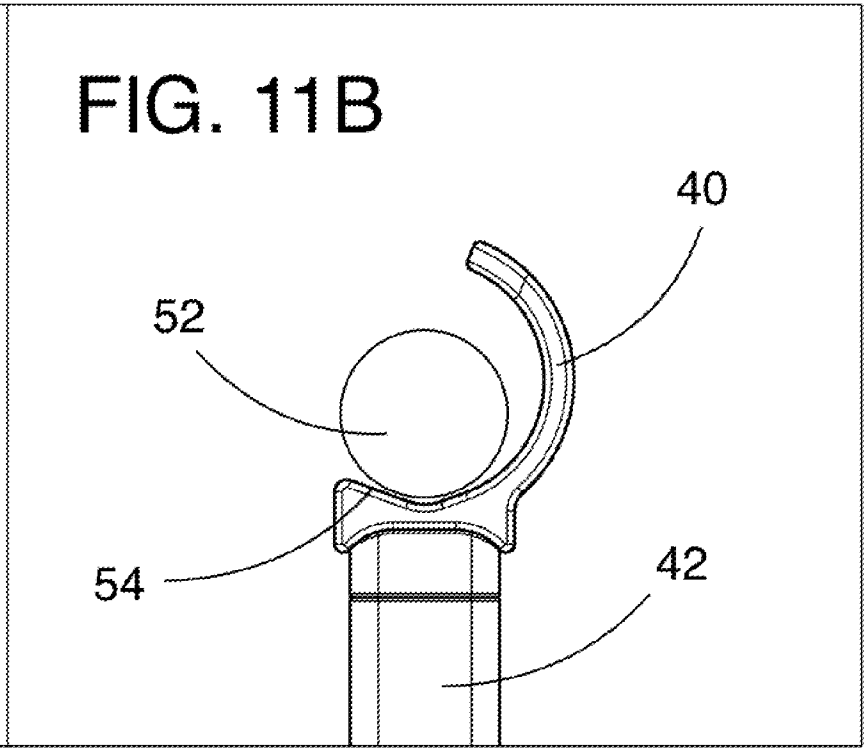
FIGS. 11A-11B are diagrams illustrating the V-shaped groove on the top surface of the axle-cup, and how the wheelchair axle self-centering action works during the lifting process according to one embodiment of the present invention.
Figure 11A:
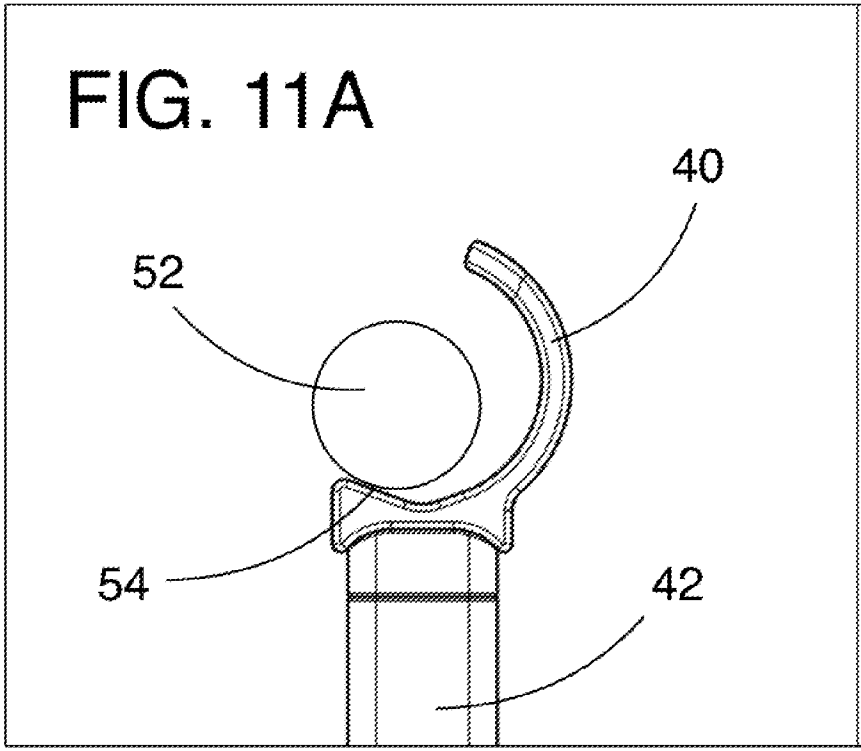

FIG. 11A is a diagram illustrating the V-shaped groove (54) on the top surface of the axle-cup (40), and how the wheelchair axle (52) self-centers during the lifting process according to one embodiment. FIG. 11B is a diagram illustrating a misaligned wheelchair axle (52) such that (52) is not centered with (42) and (40). This misalignment could be caused by an improper adjustment of the height of (42) and (40), as described in the description for FIG. 10.

FIG. 11A is a diagram illustrating the V-shaped groove (54) on the top surface of the axle-cop (40), and how the wheelchair axle (52) self-centers during the lifting process according to one embodiment. FIG. 11B is a diagram illustrating how the wheelchair axle (52) automatically aligns with the axle-cup (40) due to the V-shaped groove (54) located on the top face of the axle-cup (40). When the device is actuated, (42) and (40) are raised up, which causes (54) to contact (52) somewhere along the angled portion of (54). Thus, as (40) and (42) continue to raise, contact force between the face of (52) and the angled face of (54) cause the entire lifting device to slide forward or backward against the floor until (52) touches (54) at two points. In embodiments, the face of (52) may be slippery or otherwise provide give or various levels of friction or resistance. The geometry of (54) is a V shape, in aspects. For any round shaped (52), the V-shape of (54) will contact (52) at two points, even if the diameter of (52) changes. Thus, this allows the device to auto-center on multiple diameters of (52). In one embodiment, (40) can be scaled up in size to accommodate for unusually large diameters of (52). The auto-centering behavior of (54) will occur in a preferred manner when the coefficient of friction between (52) and (54) is low.

Figure 12A:
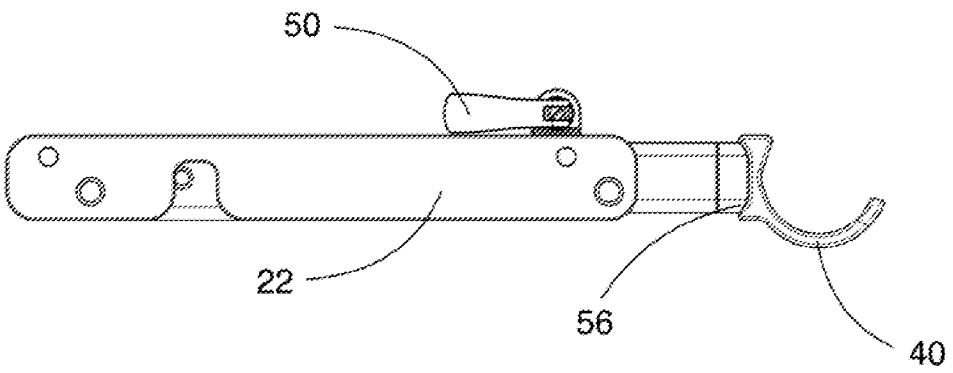
FIGS. 12A-12B are diagrams illustrating the interaction between the two bumps on the bottom surface of the axle-cup with the curve at the end of the outer horizontal links according to one embodiment of the present invention.
Figure 12B:
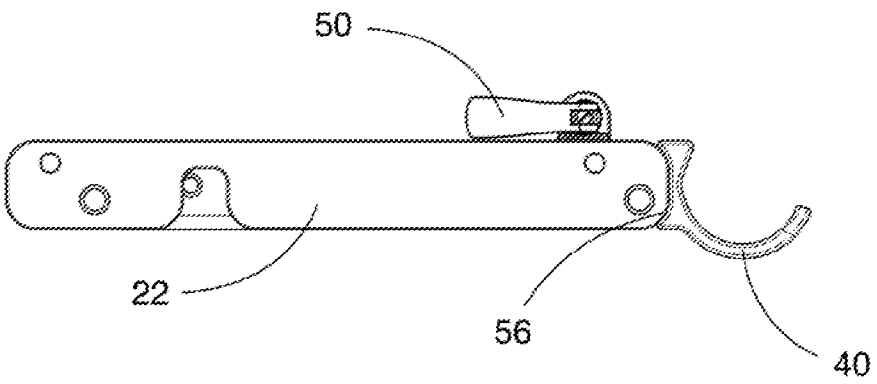

FIGS. 12A-B are diagrams illustrating the interaction between the two bumps on the bottom surface (56) of the axle-cup (40) with the curve at the end of the outer horizontal links (22) according to one embodiment of the present invention. In one embodiment, the profile of (56) may match the edge profile of (22). FIG. 12A illustrates when (50) is pulled away from the edge face of (22), (14) is free to rotate. FIG. 12B illustrates when (50) is actuated and the (40) is pushed against (22) when the device is in the closed position, (14) is prevented from rotating freely.

One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A wheelchair lift device comprising:

a linkage assembly having a parallel-bar-linkage architecture, wherein at least two parallel links of the parallel-bar-linkage architecture are moveable with respect to one another; and an extension handle in operable connection with the linkage assembly;

wherein the linkage assembly and extension handle are configured to allow a wheelchair user to independently operate the wheelchair lift device while remaining seated in the wheelchair; and wherein the extension handle is capable of actuating a lifting of the wheelchair while the user remains seated in the wheelchair when the user operates, applies force to, pulls on, pushes on, or engages the extension handle.

2. The wheelchair lift device of claim 1, wherein the linkage assembly further comprises an axle-rest assembly configured to provide for alignment and locking of the wheelchair lift device.

3. The wheelchair lift device of claim 1, wherein the linkage assembly comprises one or more linkage components configured to provide for alignment and locking of the wheelchair lift device.

4. A wheelchair lift device comprising:

two pairs of parallel links capable of moving with respect to one another due to a third link located between a first end of the two pairs of parallel links;

an extension handle connected to a second end of the two pairs of parallel links, wherein said extension handle includes one or more apparatus connected on one end to the two pairs of parallel links and on a second end to the extension handle for actuation of the wheelchair lift device.

5. The wheelchair lift device of claim 4, wherein the two pairs of parallel links that move with respect to one another remain parallel with each other during movement.

6. The wheelchair lift device of claim 4, wherein a force that causes of at least one of the two pairs of parallel links to move lifts a telescopic axle-rest assembly.

7. The wheelchair lift device of claim 6, wherein the telescopic axle-rest assembly comprises a structure capable of accommodating an axle of a wheelchair.

8. A wheelchair lift device comprising:

a parallel-bar-linkage architecture comprising:

four pairs of linkage members; and an extension handle and telescopic axle-rest assembly each in operable connection with the parallel-bar-linkage architecture;

wherein the wheelchair lift device is configured such that during use, force applied to the extension handle by a user is transferred through the extension handle and the parallel-bar-linkage architecture to cause lifting of the telescopic axle-rest assembly;

wherein the wheelchair lift device is further configured such that two of the four pairs of linkage members are caused to rotate when force is applied to the extension handle;

wherein the two pairs of linkage members that are caused to rotate comprise a first pair and a second pair, wherein the second pair has a length that is longer than a length of the first pair; and wherein each member of the second pair comprises an S-shaped bend.

9. A wheelchair lift device comprising:

a parallel-bar-linkage architecture comprising:

four pairs of linkage members; and an extension handle and telescopic axle-rest assembly each in operable connection with the parallel-bar-linkage architecture;

wherein the wheelchair lift device is configured such that during use, force applied to the extension handle by a user is transferred through the extension handle and the parallel-bar-linkage architecture to cause lifting of the telescopic axle-rest assembly;

wherein the wheelchair lift device is further configured such that two of the four pairs of linkage members are caused to rotate when force is applied to the extension handle;

wherein the two pairs of linkage members that are caused to rotate comprise a first pair and a second pair, wherein the second pair has a length that is longer than a length of the first pair;

wherein each member of the second pair comprises an S-shaped bend; and wherein one of the four pairs of linkage members comprises a groove which is sized to accommodate the S-shaped bend when the wheelchair lift device is folded in a closed position.

10. A wheelchair lift device comprising:

a parallel-bar-linkage architecture comprising:

four pairs of linkage members; and an extension handle and telescopic axle-rest assembly each in operable connection with the parallel-bar-linkage architecture;

wherein the wheelchair lift device is configured such that during use, force applied to the extension handle by a user is transferred through the extension handle and the parallel-bar-linkage architecture to cause lifting of the telescopic axle-rest assembly; wherein the extension handle comprises:

a pair of elongated grip members; and a structure comprising one or more slots; and wherein the structure comprising one or more slots bridges the pair of elongated grip members.

* * * * *